US011284702B2

(12) United States Patent
Hopke et al.

(10) Patent No.: US 11,284,702 B2
(45) Date of Patent: Mar. 29, 2022

(54) SIDE BRUSH WITH BRISTLES AT DIFFERENT LENGTHS AND/OR ANGLES FOR USE IN A ROBOT CLEANER AND SIDE BRUSH DEFLECTORS

(71) Applicant: SharkNinja Operating, LLC, Needham, MA (US)

(72) Inventors: Frederick Karl Hopke, Medway, MA (US); Alden Kelsey, Newton Upper Falls, MA (US); David Xu, Suzhou (CN); David Thomas Barker, Goole (GB); Daniel R. Der Marderosian, Westwood, MA (US); Sandy Wang, HaoCun (CN)

(73) Assignee: SharkNinja Operating LLC, Needham, MA (US)

( * ) Notice: Subject to any disclaimer, the term of this patent is extended or adjusted under 35 U.S.C. 154(b) by 246 days.

(21) Appl. No.: 15/978,811

(22) Filed: May 14, 2018

(65) Prior Publication Data

US 2018/0325252 A1 Nov. 15, 2018

Related U.S. Application Data

(60) Provisional application No. 62/506,203, filed on May 15, 2017.

(51) Int. Cl.
*A46B 9/02* (2006.01)
*A46B 13/00* (2006.01)
(Continued)

(52) U.S. Cl.
CPC ..... *A46B 9/028* (2013.01); *A46B 13/008* (2013.01); *A47L 7/02* (2013.01); *A47L 9/009* (2013.01);
(Continued)

(58) Field of Classification Search
CPC .... A47L 2201/00; A47L 2201/04; A47L 7/02; A47L 9/009; A47L 9/0472; A47L 11/16;
(Continued)

(56) References Cited

U.S. PATENT DOCUMENTS 2,241,775 A 5/1941 Forsberg
3,748,679 A 7/1973 Rosendall
(Continued)

FOREIGN PATENT DOCUMENTS

CN 2381260 Y 6/2000
CN 2389761 Y 8/2000
(Continued)

OTHER PUBLICATIONS

"Dictionary.com", "Chute | Definition of Chute" Mar. 16, 2016. (Year: 2016).*

(Continued)

*Primary Examiner* — Orlando E Aviles
*Assistant Examiner* — Thomas Raymond Rodgers
(74) *Attorney, Agent, or Firm* — Grossman Tucker Perreault & Pfleger, PLLC

(57) ABSTRACT

A robot cleaner including a body, a driven wheel, and a side brush coupled to the body. The side brush includes a hub configured to rotate about a pivot axis and a plurality of bristles. Some bristles may form a first angle with the pivot axis and others form a second angle with the pivot axis which is larger than the first angle. Some bristles may have a first bristle length and others have a second bristle length which is larger than the first bristle length. The robot cleaner may include a side brush deflector to deflect debris propelled by the side brush towards the vacuum inlet. The side brush deflector includes a plurality of deflector bristles extending downwardly from a floor facing surface of the robot cleaner
(Continued)

towards a floor such that some of the bristles pass through or underneath a portion of the deflector bristles.

18 Claims, 6 Drawing Sheets

(51) Int. Cl.
*A47L 9/00* (2006.01)
*A47L 7/02* (2006.01)
*A47L 9/04* (2006.01)

(52) U.S. Cl.
CPC ..... *A47L 9/0472* (2013.01); *A47L 2201/00* (2013.01); *A47L 2201/04* (2013.01)

(58) Field of Classification Search
CPC .... A47L 11/206; A47L 11/283; A47L 11/293; A47L 11/305; A46B 9/028; A46B 13/008
USPC ..... 15/383, 41.1, 42, 44, 47, 48
See application file for complete search history.

(56) References Cited

U.S. PATENT DOCUMENTS 3,750,215 A 8/1973 Liebscher
3,842,459 A * 10/1974 Tsuruzawa ..... A47L 11/33 15/48
3,937,174 A 2/1976 Haaga
3,978,539 A 9/1976 Yonkers
4,107,809 A 8/1978 Schuelein et al.
4,457,036 A * 7/1984 Carlson ..... A47L 11/4038 15/49.1
4,475,265 A 10/1984 Berfield
4,624,026 A 11/1986 Olson et al.
4,674,048 A 6/1987 Okumura
5,033,151 A 7/1991 Kraft et al.
5,208,521 A 5/1993 Aoyama
5,279,672 A 1/1994 Betker et al.
5,341,540 A 8/1994 Soupert et al.
5,402,051 A 3/1995 Fujiwara et al.
5,452,490 A 9/1995 Brundula et al.
5,568,589 A 10/1996 Hwang
5,634,239 A 6/1997 Tuvin et al.
5,815,880 A 10/1998 Nakanishi
5,839,156 A 11/1998 Park et al.
5,884,353 A 3/1999 Berg et al.
5,894,621 A 4/1999 Kubo
5,896,611 A 4/1999 Haaga
6,370,453 B2 4/2002 Sommer
6,381,802 B2 5/2002 Park
6,443,509 B1 9/2002 Levin et al.
6,481,515 B1 11/2002 Kirkpatrick et al.
6,590,222 B1 7/2003 Bisset et al.
6,883,201 B2 4/2005 Jones et al.
7,079,923 B2 7/2006 Abramson et al.
7,299,521 B2 11/2007 Theiss, Jr. et al.
7,350,268 B2 4/2008 Anderson et al.
7,367,085 B2 5/2008 Bagwell et al.
7,444,206 B2 10/2008 Abramson et al.
7,571,511 B2 8/2009 Jones et al.
7,673,367 B2 3/2010 Kim et al.
7,827,654 B2 11/2010 Nishikawa
8,438,695 B2 5/2013 Gilbert, Jr. et al.
8,474,090 B2 7/2013 Jones et al.
8,656,550 B2 2/2014 Jones et al.
8,671,507 B2 3/2014 Jones et al.
8,763,199 B2 7/2014 Jones et al.
8,806,711 B2 8/2014 Jang
8,869,342 B2 10/2014 Yoon et al.
9,038,233 B2 5/2015 Jones et al.
9,078,552 B2 7/2015 Han et al.
9,167,946 B2 10/2015 Jones et al.
9,173,539 B2 11/2015 Yoon et al.
9,226,635 B2 * 1/2016 Kim ..... B25J 9/0003
9,414,734 B2 8/2016 Moon et al.
9,480,379 B2 11/2016 Yoon et al.
9,648,999 B2 5/2017 Uphoff et al.
9,737,188 B2 8/2017 Jang et al.
9,756,997 B2 9/2017 Maoro et al.
9,867,516 B2 1/2018 Yoon et al.
9,931,012 B2 4/2018 Ichikawa et al.
9,955,839 B2 5/2018 Maoro et al.
2002/0092125 A1 7/2002 Vystrcil et al.
2004/0221406 A1 11/2004 Grey
2005/0214060 A1 * 9/2005 Svendsen ..... A46B 11/0013 401/140
2008/0196187 A1 * 8/2008 Chavana ..... A46B 13/008 15/180
2013/0152332 A1 6/2013 Jang
2013/0291331 A1 11/2013 Yang et al.
2014/0259475 A1 9/2014 Doughty
2015/0182087 A1 7/2015 Gerth
2015/0265122 A1 9/2015 Han et al.
2015/0272414 A1 10/2015 Janzen et al.
2016/0143496 A1 5/2016 Penner
2016/0157692 A1 * 6/2016 Maoro ..... A46B 9/02 15/300.1
2016/0166127 A1 6/2016 Lewis
2017/0049289 A1 2/2017 Ichikawa et al.

FOREIGN PATENT DOCUMENTS

CN 201573207 U 9/2010
CN 204074580 U 1/2015
DE 2229967 A1 1/1974
DE 9420524 U1 2/1995
DE 19544999 A1 6/1997
DE 102016120321 A1 4/2017
EP 0424229 A1 4/1991
GB 798845 7/1958
GB 1426686 A 3/1976
GB 2213047 A 8/1989
GB 2306306 A 5/1997
GN 205083396 U 3/2016
JP S53107060 U 8/1978
JP 62109528 A 5/1987
JP 0542075 2/1993
JP H05074452 U 3/1993
JP 06254020 A 9/1994
JP 0747044 A 2/1995
JP 0759695 A 3/1995
JP 07129239 A 5/1995
JP 07204143 A 8/1995
JP 07322977 A 12/1995
JP 0848197 A 2/1996
JP 0880277 A 3/1996
JP 09206258 A 8/1997
JP 2000353014 A 12/2000
JP 2001087182 A 4/2001
JP 03204857 B2 9/2001
JP 2003038402 A 2/2003
JP 3660042 B2 6/2005
JP 2013230199 A * 11/2013
JP 2016154597 A 9/2016
JP 2017074258 A 4/2017
WO 2016091320 A1 6/2016
WO WO-2016098392 A1 * 6/2016 ..... A47L 9/28

OTHER PUBLICATIONS

"Dictionary.com","Continuously | Definition of Continuously", Mar. 14, 2016. (Year: 2016).*
Translation of JP2013230199A, retrieved from Espacenet on Nov. 11, 2020 (Year: 2013).*
Translation of Wo2016098392A1 retrieved from Espacenet on Jun. 1, 2021 (Year: 2016).*
PCT Search Report and Written Opinion dated Aug. 7, 2018, received in corresponding PCT Application No. PCT/US18/32658, 11 pgs.

(56) References Cited

OTHER PUBLICATIONS

Chinese Office Action with English translation dated Nov. 25, 2020, received in Chinese Patent Application No. 201880040095.6, 12 pages.
Japanese Office Action with English translation dated Dec. 25, 2020, received in Japanese Patent Application No. 2019-563159, 11 pages.
European Search Report dated Feb. 10, 2021, received in European Patent Application No. 18801836.0, 7 pages.
Canadian Examiner's Report dated Jan. 22, 2021, received in Canadian Patent Application No. 3,063,857, 4 pages.
Canadian Office Action dated Oct. 6, 2021, received in Canadian Patent Application No. 3,063,857, 6 pages.

* cited by examiner

SIDE BRUSH WITH BRISTLES AT DIFFERENT LENGTHS AND/OR ANGLES FOR USE IN A ROBOT CLEANER AND SIDE BRUSH DEFLECTORS

CROSS REFERENCE TO RELATED APPLICATIONS

The present application claims the benefit of U.S. Provisional Patent Application Ser. No. 62/506,203, filed May 15, 2017, which his fully incorporated herein by reference.

FIELD

The present disclosure relates generally to robot cleaners and more specifically to side brushes for robot cleaners.

BACKGROUND

Robot cleaners (e.g., robot vacuum cleaners, robot mops, robot dusters, etc.) may clean a surface (e.g., a floor) based on one or more programmed cleaning modes (e.g., a wall-following mode, a random pattern mode, a spot mode, etc.). The cleaning modes cause the robot cleaner to traverse a floor pursuant to one or more preprogrammed instructions. While traversing the floor, the robot cleaner utilizes a cleaning instrument (e.g., a vacuum system, a mop, a dust pad, etc.) to remove debris on the floor.

For example, a robot vacuum cleaner may include one or more driven wheels, a vacuum system, and a side brush. One example of a side brush may have tufts of bristles extending from a hub and spaced apart around the periphery of the hub. Another example of a side brush may have individual bristles extending singly from the hub and continuously around the hub. The bristles may extend beyond a periphery of the robot vacuum cleaner such that the rotation of the side brush urges debris beyond the periphery of the robot vacuum cleaner in a direction of the robot vacuum cleaner. For example, the side brush may urge debris from a corner of a room into a suction inlet of the vacuum system.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

A side brush for use with a robot cleaner, consistent with embodiments disclosed herein, includes bristles extending from a hub at different lengths and/or angles relative to the hub. The hub may be configured to rotatably couple to the robot cleaner. In some embodiments, the plurality of bristles extend individually and continuously around at least a portion of the hub. The side brush may include, for example, groups of bristles at different lengths and/or at different angles relative to the hub.

By varying one or more of the bristle length and/or the bristle angle, the performance of a robot cleaner may be improved. The longer bristles allow a longer reach and larger sweeping area, while the shorter bristles reduce interference with the items on the surface being cleaned. For example, when rotating, the side brush may engage one or more surface treatments (e.g., an area rug) residing on a floor. A side brush having bristles of the same length and extending at the same angle may have a tendency to become entangled with, for example, an area rug residing on a floor. By adjusting the length and/or angle of one or more bristles, it may become less likely that the side brush will become entangled.

Figure 1:
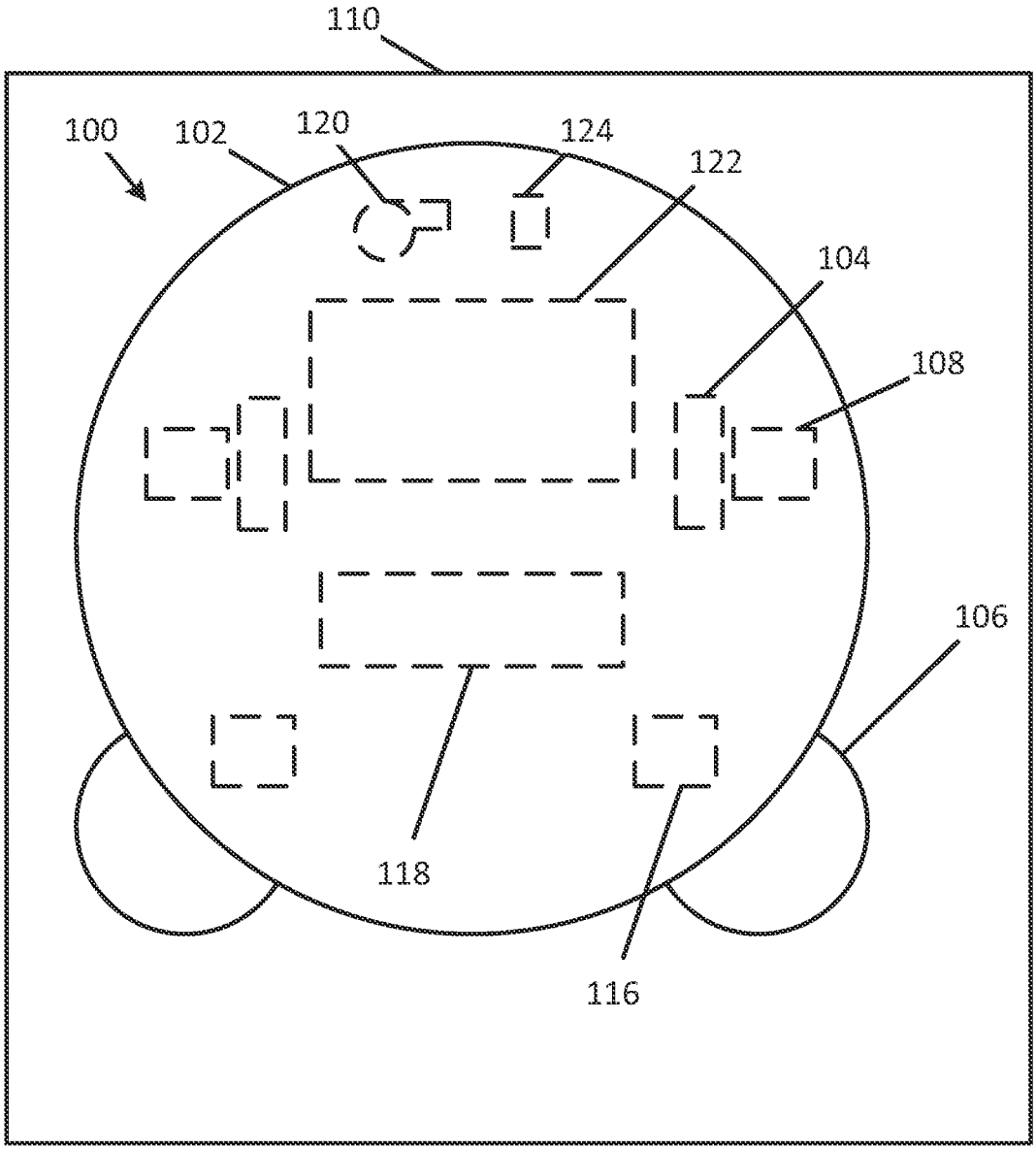
FIG. 1 is schematic plan view of an example of a robot cleaner including a side brush, consistent with embodiments of the present disclosure.

FIG. 1 shows a schematic plan view of an example of a robot cleaner 100 having a body 102, a plurality of driven wheels 104, and at least one side brush 106. The driven wheels 104 are coupled to at least one drive motor 108 such that actuation of the drive motor 108 causes the driven wheels 104 to urge the robot cleaner 100 across a surface 110 (e.g., a floor). The side brush 106 is rotatably coupled to the body 102 such that a brush motor 116 coupled to the side brush 106 causes a rotation of the side brush 106. Alternatively, the side brush 106 may be coupled to the drive motor 108 such that the drive motor 108 may cause the side brush 106 to rotate.

Rotation of the side brush 106 may urge debris on the surface 110 in a direction of a vacuum inlet 118. In one example, at least a portion of the side brush 106 extends beyond a periphery of the body 102 such that debris adjacent the body 102 can be urged into the vacuum inlet 118. The vacuum inlet 118 is fluidly coupled to a vacuum motor 120 such that air is drawn from the vacuum inlet 118 through a debris collector 122 to a vacuum outlet 124. At least a portion of the debris entrained within the air drawn through the vacuum inlet 118 is deposited within the debris collector 122. In some instances, one or more filters are disposed within the airflow path extending between the debris collector 122 and the vacuum outlet 124 to collect any debris not deposited in the debris collector 122.

Figure 2A:
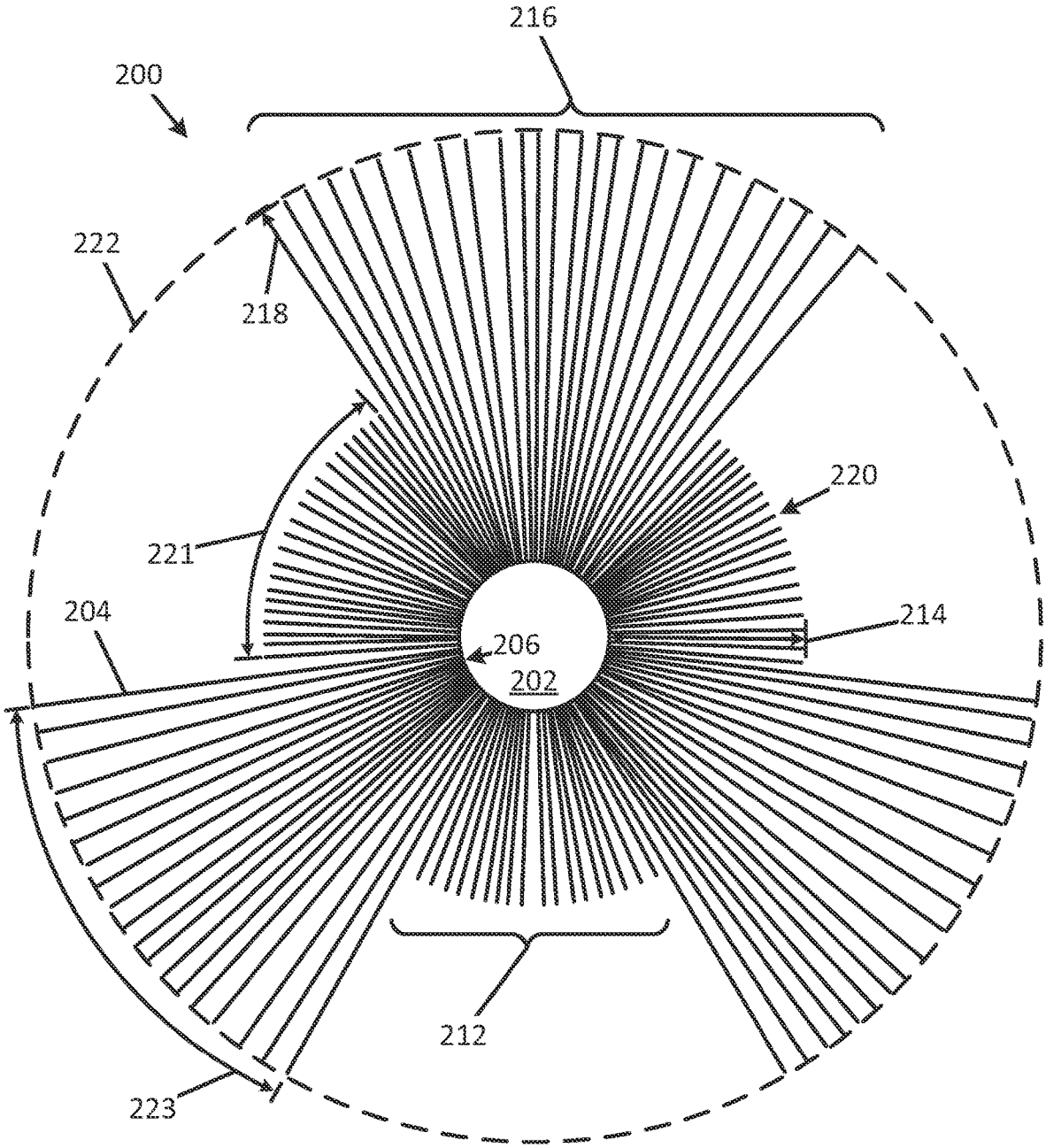
FIG. 2A is a schematic plan view of an example of a side brush with different length bristles extending individually from a hub, consistent with embodiments of the present disclosure.

FIG. 2A shows a schematic plan view of a side brush 200 with different length bristles, which may be an example of the side brush 106 of FIG. 1. As shown, the side brush 200 includes a hub 202 and a plurality of bristles 204 extending individually away from a peripheral surface 206 of the hub 202. The bristles 204 may be coupled to the hub 202 such that the bristles 204 extend continuously around the hub 202 forming a full or partial circular brush configuration. As used herein, bristles 204 are defined as extending continuously around the hub 202 if the plurality of bristles 304 collectively extend from and around at least 80% of the perimeter (e.g., circumference) of the hub 302 and the separation distance 210 between each bristle 204 and at least one adjacent bristle 204 is less than or equal to twice a width of widest bristle 204 of the plurality of bristles 204. For example, the separation distance 210 may be less than or equal to one width of the widest bristle 204 of the plurality of bristles 204, in a range of one-half to twice the width of the widest bristle 204 of the plurality of bristles 204, and/or at least a portion of each bristle 204 may be directly adjacent (e.g., contacting) at least one other bristle 204. The separation distance 210 may be measured between the ends of adjacent bristles 204 and/or between the bases of adjacent bristles 204.

Each of the bristles 204 may be coupled to and extend from a common carrier or substrate (e.g., a bristle strip) that at least partially circumscribes the peripheral surface 206 of the hub 202. In some instances, the bristles 204 completely circumscribe the hub 202. In the illustrated example, the bristles 204 extend from the hub 202 as individual bristles, rather than tufts of bristles.

In the illustrated embodiment, a first plurality of bristles 212 has a first bristle length 214 and a second plurality of bristles 216 has a second bristle length 218. As used herein, the length of the bristles 204 is measured between the periphery surface 206 of the hub 202 and the distal most end of the bristles 204. In the illustrated embodiment, the first bristle length 214 measures less than the second bristle length 218. A ratio of the first bristle length 214 to the second bristle length 218 may, for example, be in a range of 5:6 to 1:3. By way of further example, a ratio of the first bristle length 214 to the second bristle length 218 may be in a range of 2:3 to 1:2. By way of even further example, a ratio of the first bristle length 214 to the second bristle length 218 may be 1:1.

Although the illustrated embodiment includes groups of bristles with two different lengths, individual bristles and/or groups of bristles may have more than two different lengths in other embodiments. In some instances, each bristle of the plurality of bristles 204 may have a bristle length measuring different from that of an adjacent bristle of the plurality of bristles 204. In other words, the length of the bristles 204 vary as the bristles 204 extend along the peripheral surface 206 of the hub 202. In these instances, the bristles 204 may be arranged according to their length such that distal ends 220 of the bristles 204 collectively define a waveform-shaped pattern. Example waveform-shaped patterns may include a sinusoidal waveform pattern, a square waveform pattern, a trapezoidal waveform pattern, and/or any other waveform pattern.

In the illustrated embodiment, the first plurality of bristles 212 extends around the hub 202 for a first circumferential distance 221 and the second plurality of bristles 216 extends around the hub 202 for a second circumferential distance 223. A ratio of the first circumferential distance 221 to the second circumferential distance 223 may measure in a range of 8:1 to 1:2. By way of further example, a ratio of the first circumferential distance 221 to the second circumferential distance 223 may measure in a range of 4:1 to 1:1. By way of even further example, a ratio of the first circumferential distance 221 to the second circumferential distance 223 may measure in a range of 3:1 to 1:1

A swept area 222 of the side brush 200 may be defined as the area through which at least one of the bristles 204 passes upon a full rotation of the side brush 200. A proportion of the swept area 222 occupied by the bristles 204 may influence the cleaning effectiveness of the side brush 200. For example, the bristles 204 may occupy at least 40% of the swept area, at least 50% of the swept area, at least 60% of the swept area, at least 70% of the swept area, at least 80% of the swept area, at least 90% of the swept area, or any other suitable proportion.

Figure 2B:
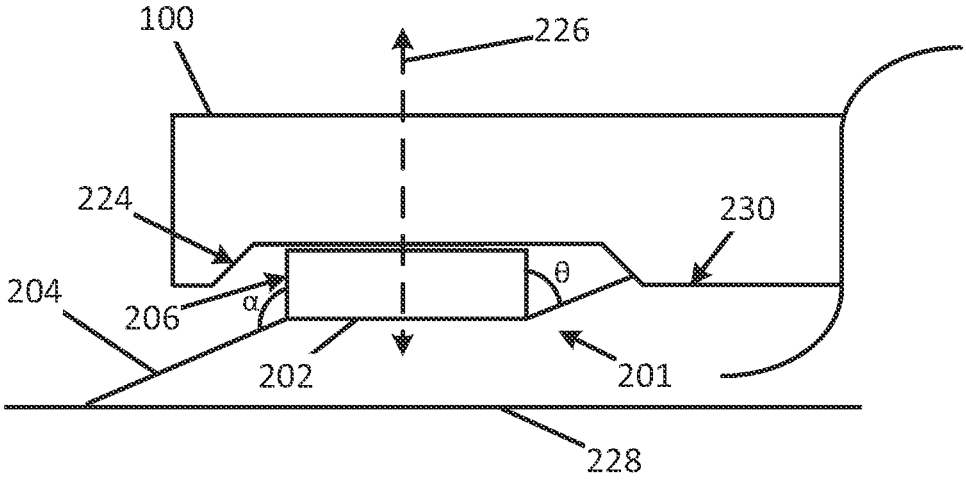
FIG. 2B is a schematic side view of an example of a side brush with bristles extending from a hub at different angles relative to the hub, consistent with embodiments of the present disclosure.

FIG. 2B shows a schematic plan view of an example of a side brush 201 with bristles at different angles relative to the hub 202. The side brush 201 may have bristles of all the same length or different lengths as describe above. As shown, the side brush 201 is rotatably coupled to the robot cleaner 100 within a well 224 such that the side brush 201 rotates about a rotation axis 226 extending generally perpendicular to a floor 228. The well 224 defines a recessed region within the robot cleaner 100 that extends from a floor facing surface 230 of the robot cleaner 100 in a direction away from the floor 228.

The side brush 201 includes a plurality bristles 204 extending away from the peripheral surface 206 of the hub 202. As shown, one or more of the bristles 204 forms a first angle θ with the peripheral surface 206 of the hub 202, the rotation axis 226, and/or an axis perpendicular to the floor 228, while at least another one of the bristles 204 forms a second angle α with the peripheral surface 206, the rotation axis 226, and/or an axis perpendicular to the floor 228. The first angle θ and second angle α are both measured vertically between the bristles 204 and the peripheral surface 206 and/or the rotation axis 226 as generally illustrated. The first angle θ may be selected such that the bristles 204 extend from the hub 202 in a direction generally towards the floor facing surface 230 of the robot cleaner 100. In some instances, at least a portion of at least one bristle 204 engages (e.g., contacts) the floor facing surface 230. The second angle α may be selected such that the bristles 204 extend from the hub 202 in a direction generally towards the floor 228. In some instances, at least a portion of at least one bristle 204 engages (e.g., contacts) the floor 228. Although the schematic illustration shows two bristles and two different angles, individual bristles and/or groups of bristles may extend from the hub 202 at more than two different angles.

In the illustrated embodiment, the first angle θ measures less than the second angle α. For example, the first angle θ may measure less than 90° and the second angle α may measure greater than 90°. By way of more specific example, the first angle θ may measure in a range of 40° to 90° and the second angle α may measure in a range of 90° to 140°. The bristles 204 may extend from the hub 202 at angles that vary within these ranges. As such, the bristles 204 may generally be described as defining a waveform-shaped pattern extending around the hub 202. For example, the bristles 204 may extend around the hub 202 such that a sinusoidal waveform pattern, a square waveform pattern, a trapezoidal waveform pattern, and/or any other waveform pattern is formed.

Figure 2C:
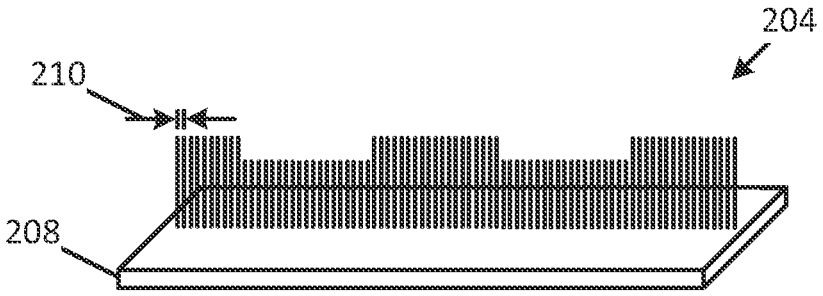
FIG. 2C is a schematic perspective view of an example of bristle strip that may be used to form the side brushes shown in FIGS. 2A and 2B, consistent with embodiments of the present disclosure.

FIG. 2C shows a schematic perspective view of an example of a bristle strip that may be used to form the side brush. The bristle strip includes the plurality of bristles 204 extending from a carrier or substrate 208, which may be coupled around the hub 202. In some instances, the substrate 208 is coupled to the peripheral surface 206 of the hub 202 such that the bristles 204 extend from the hub 202. For example, the substrate 208 may be adhesively coupled to the peripheral surface 206. In some instances, at least a portion of the substrate 208 is received within a groove within the hub 202 such that the bristles 204 extend along a peripheral edge of the hub 202. In other embodiments, each bristle 204 may be coupled directly to the hub 202. In some instances, the hub 202 may include a plurality of openings capable of receiving at least a portion of a corresponding bristle 204. Additionally, or alternatively, one or more of the bristles 204 may be formed from or molded into the hub 202.

Figure 3:
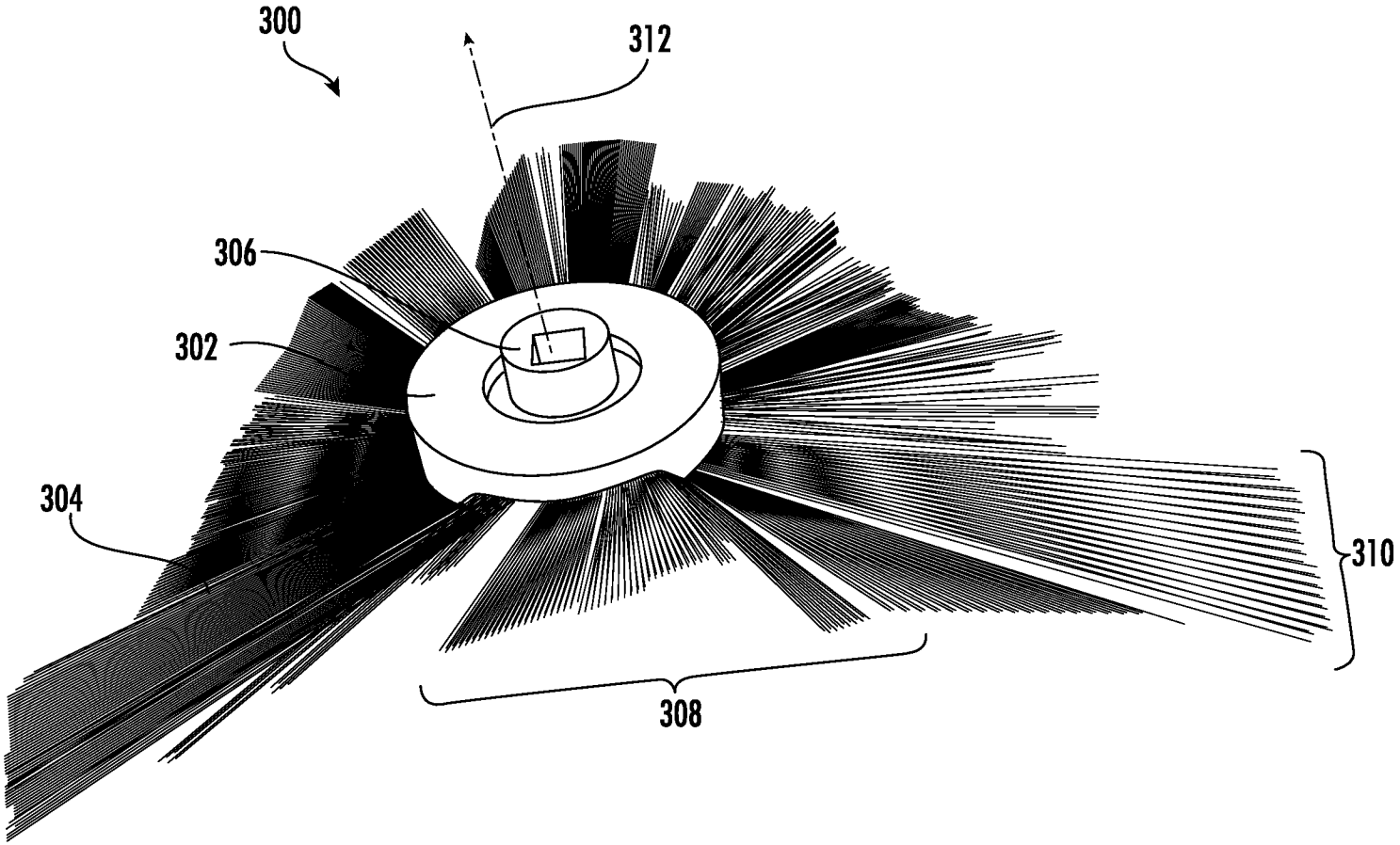
FIG. 3 is a perspective view of another embodiment of a side brush including bristles extending individually from a hub at different lengths and angles.

FIG. 3 shows a perspective view of a side brush 300 with bristles having both different lengths and different angles, which may be an example of the side brush 106 of FIG. 1. The side brush 300 includes a hub 302, a plurality of bristles 304, and a connector 306. The connector 306 is configured to rotatably couple the side brush 300 to a robot cleaner (e.g., the robot cleaner 100 of FIG. 1). As shown, the connector 306 extends from the hub 302 such that the connector 306 can be received within a corresponding receptacle in the robot cleaner. Alternatively, the connector 306 may be a receptacle extending at least partially through the hub 302 such that the connector 306 can receive a corresponding protrusion extending from the robot cleaner.

As shown, when coupled to the hub 302, a first plurality of bristles 308 extend in a direction of the robot cleaner and a second plurality of bristles 310 extend in a direction away from the robot cleaner. In other words, the first plurality of bristles 308 and the second plurality of bristles 310 extend in generally opposing directions along a rotation axis 312 of the hub 302 (e.g., up and down). The different angles of the bristles 308, 310 may be formed, for example, by bending or permanently deforming the bristles, by having the bristles extend at the different angles from the hub 302 or from the carrier (e.g., substrate 208 in FIG. 2C), and/or by having a structure (e.g. a protrusion) extending from the hub 302.

Figure 4:
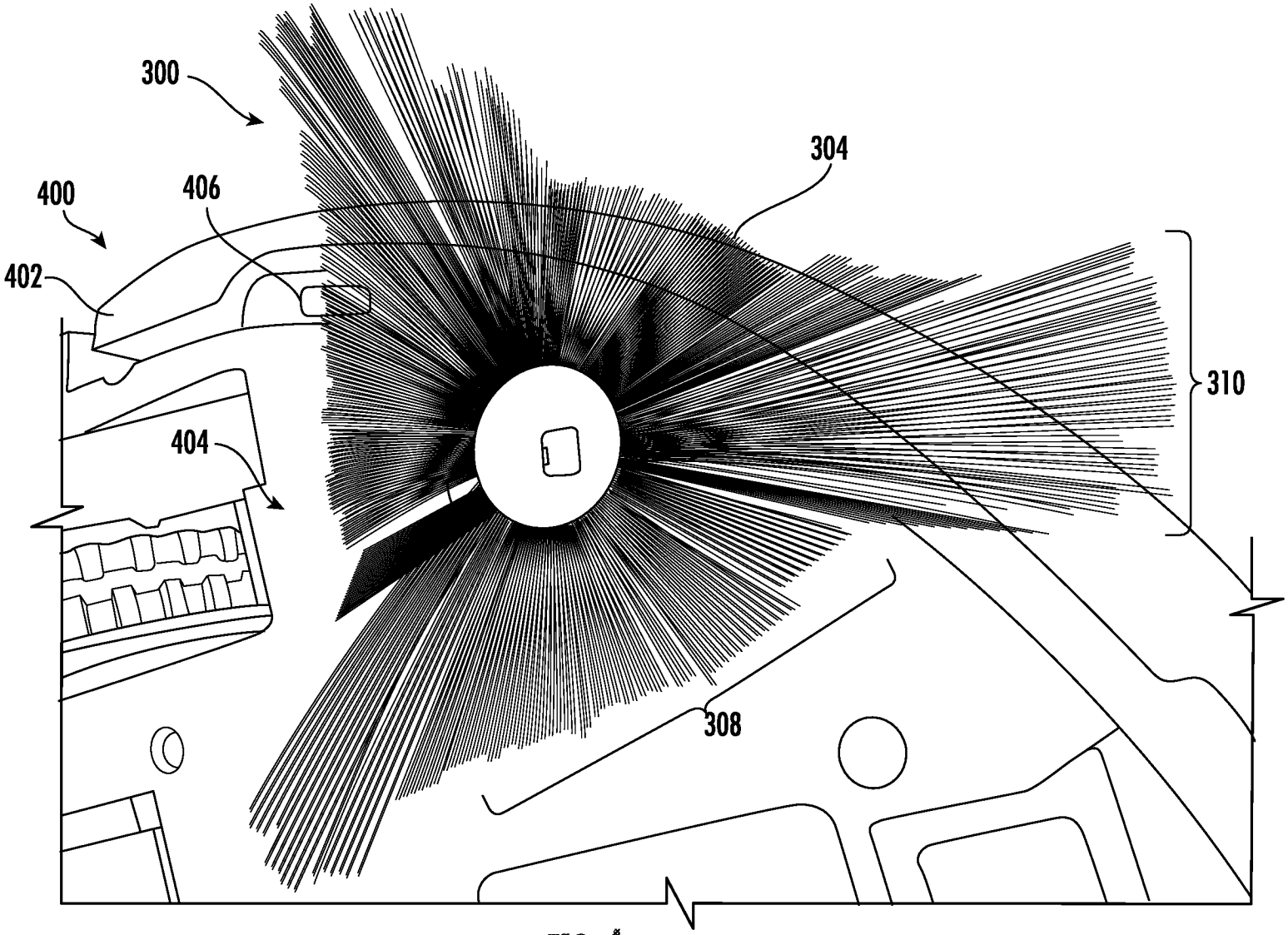
FIG. 4 is a perspective view of the side brush of FIG. 3 coupled to a robot cleaner, consistent with embodiments of the present disclosure.

FIG. 4 shows an example of the side brush 300 coupled to a robot cleaner 400, which may be an example of the robot cleaner 100 of FIG. 1. The side brush 300 may be rotatably coupled to the robot cleaner 400 proximate a bumper 402 such that at least a portion the bristles 308 and/or the bristles 310 extends beyond the robot cleaner 400. In other embodiments, the bristles 308 and/or bristles 310 may not extend beyond the periphery of the robot cleaner 400.

In the illustrated embodiment, the first plurality of bristles 308 extends in a direction of the robot cleaner 400. In some instances, at least a portion of the first plurality of bristles 308 engage (e.g., contact) a bottom surface 404 of the robot cleaner 400. As such, as the side brush 300 rotates, the first plurality of bristles 308 slide along the bottom surface 404 of the robot cleaner 400. The second plurality of bristles 310 may extend in a direction away from the robot cleaner 400 such that at least a portion of the second plurality of bristles 310 engages a surface (e.g., a floor). As such, as the side brush 300 rotates, the second plurality of bristles 310 may urge debris residing on a surface in a direction of the robot cleaner 400 (e.g., in a direction of a vacuum inlet).

In some embodiments, the robot cleaner 400 includes one or more sensors. The sensors may include, for example, a cliff sensor 406 capable of detecting a change in height of a surface on which the robot cleaner 400 is traveling. The cliff sensor 406 may be used to prevent the robot cleaner 400 from traversing a region having a sudden change in elevation greater than a predetermined value. For example, when the robot cleaner 400 approaches the edge of a stairwell, the robot cleaner 400 may stop and/or turn away from the stairwell such that the robot cleaner 400 does not fall down one or more stairs.

In the illustrated embodiment, the longer bristles 310, but not the shorter bristles 308, pass between the cliff sensor 406 and a surface when the side brush 300 rotates. As such, the rotation of the side brush 300 does not interfere with the operation of the cliff sensor. In other embodiments where the side brush includes bristles of the same length, the bristles may extend individually from the hub with a spacing between the individual bristles that allows the cliff sensor to operate when the bristles pass between the cliff sensor 406 and the surface.

As also shown in FIG. 4, in some instances, the bristles 304 extend continuously around the hub 302 without completely circumscribing the hub 302. For example, the bristles 304 may extend around at least 80% of the hub 302, at least 90% of the hub 302, at least 95% of the hub 302, at least 99% of the hub 302, or any other suitable circumferential distance. Further, while the hub 302 has been generally illustrated herein as having a circular cross-section, such a configuration is non-limiting. For example, the hub 302 may have a square-shaped cross section, a rectangle-shaped cross section, a triangular-shaped cross section, an octagonal-shaped cross section, a pentagonal-shaped cross section, or any other suitable cross section.

Although the illustrated embodiments show multiple groups of bristles with different lengths and/or angles, a side brush may include only one group of bristles with one length and/or angle and one group of bristles with the other length and/or angle. Although the exemplary embodiments show bristles extending individually and continuously around a hub, a side brush with bristles having different lengths and/or angles relative to the hub may also be formed by tufts of bristles extending from a hub.

Figure 5:
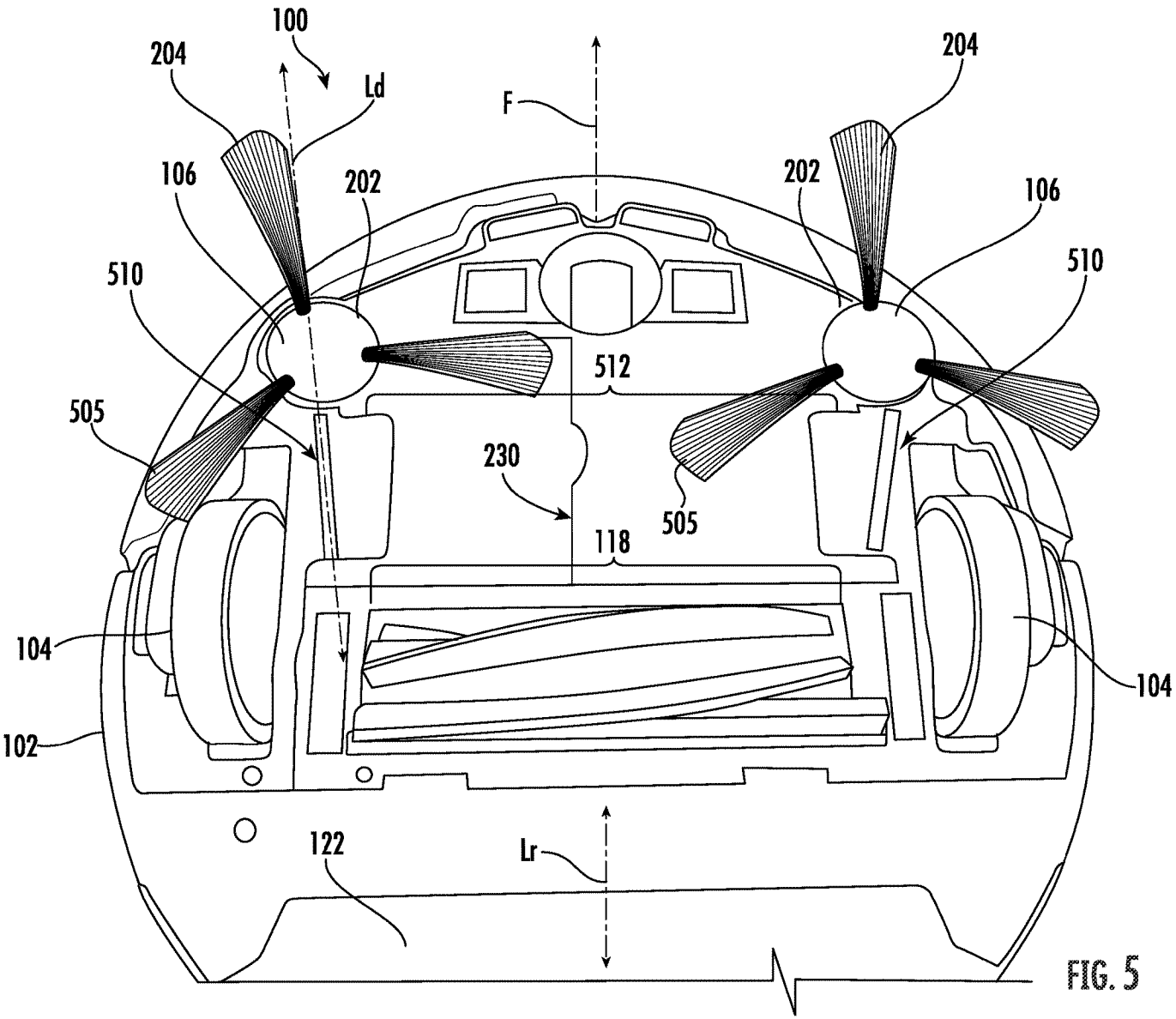
FIG. 5 is a bottom view of another embodiment of a robot cleaner including a side brush and side brush deflector.

FIG. 5 shows an example of one embodiment of a robot cleaner 100 including one or more side brush debris deflectors 500. The robot cleaner 100 may include a body 102, a plurality of driven wheels 104, and at least one side brush 106. The driven wheels 104 are coupled to at least one drive motor 108 (not shown for clarity) such that actuation of the drive motor 108 causes the driven wheels 104 to urge the robot cleaner 100 across a surface 110 (e.g., a floor). The side brush 106 is rotatably coupled to the body 102 such that a brush motor 116 (not shown for clarity) and/or drive motor 108 coupled to the side brush 106 causes a rotation of the side brush 106.

The side brushes 106 may include any side brush design known to those skilled in the art. In at least one embodiment, one or more of the side brushes 106 may include one or more tufts 505 of bristles 204 extending from the hub 202 as generally illustrated in FIG. 5. In the illustrated embodiment, the side brush 106 includes a plurality of tufts 505 of bristles 204 having the same length; however, it should be appreciated that one or more of the bristles 204 in a tuft 505 may have a different length and/or that one or more of the plurality of tufts 505 may have bristles 204 having a different length than the bristles 204 of another one of the plurality of tufts 505. Alternatively, one or more of the side brushes 106 may include any of the side brushes 106 described herein. For example, one or more of the side brushes 106 may include a plurality of bristles 204 which extend continuously around the hub 202. At least one of the plurality of bristles 204 may form a first angle with the peripheral surface of the hub 202 and at least one of the plurality of bristles 204 may form a second angle with the peripheral surface of the hub 202 which is greater than the first angle and/or at least one of the plurality of bristles 204 may have a first bristle length and at least one of the plurality of bristles 204 has a second bristle length, the first bristle length is less than the second bristle length.

In any case, rotation of the side brush 106 is intended to urge debris on the surface 110 in a direction of a vacuum inlet 118. In one example, at least a portion of the side brush 106 extends beyond a periphery of the body 102 such that debris adjacent the body 102 can be urged towards the vacuum inlet 118. As may be appreciated, however, the side brushes 106 may contact debris and inadvertently cause the debris to be spun around the side brush 106 (e.g., between the side brush 106 and the driven wheels 104 and/or between the driven wheels 104 and the vacuum inlet 118) and ejected beyond the robot cleaner 100. As a result, the debris may not be urged towards the vacuum inlet 118, and thus may not be picked up by the robot cleaner 100.

To address this problem, the robot cleaner 100 may include one or more side brush deflectors 510 configured to reduce and/or eliminate debris from being inadvertently spun around the side brush 106 and ejected beyond the robot cleaner 100. The side brush deflector 510 may therefore be configured to trap and/or collect debris in an area 512 under the robot cleaner 100 and in front on the vacuum inlet 118. As a result, debris propelled by the side brushes 160 will be directed towards the vacuum inlet 118 and ultimately drawn through the vacuum inlet 118 and deposited within the debris collector 122.

The side brush deflector 510 may include a strip of flexible material and/or a plurality of bristles 512 (also referred to as deflector bristles) extending downwardly from the floor facing surface 230 of the robot cleaner 100 generally towards the floor. The side brush deflector 510 may be sufficiently flexible to allow the side brush deflector 510 to generally conform to varying surface contours. The side brush deflector 510 may extend downwardly from the floor facing surface 230 partially and/or all the way towards the floor. Some or all of the bristles 204 of the side brush 106 may pass through at least a portion of the side brush deflector 510. Alternatively (or in addition), some or all of the bristles 204 of the side brush 106 may pass below at least a portion of the side brush deflector 510.

In the illustrated embodiment, the side brush deflector 510 is shown as a substantially continuous strip of flexible material and/or a plurality of bristles 512; however, it should be appreciated that the side brush deflector 510 may not be continuous. For example, the side brush deflector 510 may be formed by a plurality of discrete and/or discontinuous sections. The side brush deflector 510 may have a linear or non-linear configuration. The side brush deflector 510 may be extend within all or a portion of a region between the side brushes 106 and the vacuum inlet 118 and/or an agitator 514; however, a portion of the side brush deflector 510 may also extend in a region forward of the side brushes 106 (i.e., closer to the front of the robot cleaner 100 than the side brushes 106) and/or behind the vacuum inlet 118 and/or an agitator 514 (i.e., closer to the rear of the robot cleaner 100 than the vacuum inlet 118 and/or an agitator 514).

One or more of the side brush deflectors 510 may be arranged with a longitudinal axis Ld that is either parallel to or non-parallel to the longitudinal axis Lr and/or the forward direction F of the robot cleaner 100. In the illustrated embodiment, the robot cleaner 100 is shown having two side brush deflectors 510 arranged with longitudinal axes Ld that are non-parallel to the longitudinal axis Lr and/or the forward direction F of the robot cleaner 100. For example, the side brush deflector 510 may be arranged to form a debris chute or channel 512. The debris chute or channel 512 is defined as an area extending laterally between the side brush deflectors 510 and extending vertically between the floor facing surface 230 of the robot cleaner 100 and floor. The debris chute or channel 512 may be configured to generally direct debris towards the vacuum inlet 118 and/or an agitator 514 (which may be disposed at least partially within vacuum inlet 118 and/or separately from the vacuum inlet 118). According to one embodiment, the debris chute or channel 512 may have generally tapered configuration in which the lateral dimension of the debris chute or channel 512 (i.e., the left to right dimension) becomes smaller when moving closer to the vacuum inlet 118 and/or an agitator 514. The tapered configuration of the debris chute or channel 512 may aid in directing debris towards the vacuum inlet 118 and/or an agitator 514 while also allowing the side brushes 106 to be disposed further apart laterally from each other (thus increasing the sweep area 222 (FIG. 2A) of the side brushes 106. The taper of the debris chute or channel 512 may be either linear or nonlinear. While the illustrated embodiment of the robot cleaner 100 is shown having two side brush deflectors 510, it should be appreciated that the robot cleaner 100 may have only one side brush deflector 510 or more than two side brush deflectors 510.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a vacuum attachment may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A robot cleaner comprising:

a body including a front, a rear, and a vacuum inlet disposed therebetween;

at least one driven wheel;

at least one side brush comprising a hub configured to rotate about a pivot axis and a plurality of side brush bristles extending from the hub, the pivot axis being disposed in front of the vacuum inlet; and at least one side brush deflector at least partially disposed between the vacuum inlet and the pivot axis of the at least one side brush, the at least one side brush deflector comprising a plurality of deflector bristles extending downwardly from a floor facing surface of the robot cleaner and configured to contact a floor such that the plurality of deflector bristles are configured to deflect debris propelled by the at least one side brush towards the vacuum inlet and at least some of the plurality of side brush bristles pass through or underneath at least a portion of the plurality of deflector bristles.

2. The robot cleaner of claim 1, wherein the at least one side brush includes a first and a second side brush, and wherein the at least one side brush deflector includes a first and a second side brush deflector extending downwardly from the floor facing surface of the robot cleaner generally towards the floor such that at least some of the plurality of bristles of the first and second side brushes pass through or underneath at least a portion of the plurality of deflector bristles of the first and the second side brush deflectors, respectively, the first and the second side brush deflectors arranged to form a debris chute configured to deflect debris propelled by the first and second side brush towards the vacuum inlet.

3. The robot cleaner of claim 2, wherein the debris chute tapers in a direction moving from the front of the robot cleaner towards the vacuum inlet.

4. The robot cleaner of claim 1, wherein the at least one side brush deflector is disposed at least partially between the driven wheel and the vacuum inlet.

5. The robot cleaner of claim 1, wherein the at least one side brush is configured to rotate about the pivot axis substantially perpendicular to the floor facing surface of the robot cleaner.

6. The robot cleaner of claim 1, further comprising an agitator disposed at least partially within the vacuum inlet.

7. The robot cleaner of claim 1, wherein the at least one side brush deflector includes a first and a second side brush deflector extending along a first and a second longitudinal axis and downwardly from the floor facing surface of the robot cleaner generally towards the floor, wherein the first and second longitudinal axes tapered towards the vacuum inlet.

8. A robot cleaner comprising:

a body including a front, a rear, and a vacuum inlet disposed therebetween;

at least one driven wheel;

at least one side brush comprising a hub configured to rotate about a pivot axis and a plurality of side brush bristles extending from the hub, the pivot axis being disposed in front of the vacuum inlet; and at least one side brush deflector at least partially disposed between the vacuum inlet and the pivot axis of the at least one side brush, the at least one side brush deflector comprising at least one of a strip of flexible material or a plurality of deflector bristles extending downwardly from a floor facing surface of the robot cleaner and contact a floor such that the at least one side brush deflector is configured to deflect debris propelled by the at least one side brush towards the vacuum inlet and at least some of the plurality of side brush bristles pass through or underneath the at least one side brush deflector.

9. The robot cleaner of claim 8, wherein the at least one side brush includes a first and a second side brush, and wherein the at least one side brush deflector includes a first and a second side brush deflector extending downwardly from the floor facing surface of the robot cleaner generally towards the floor such that at least some of the plurality of bristles of the first and second side brushes pass through or underneath at least a portion of the first and the second side brush deflectors, respectively.

10. The robot cleaner of claim 9, wherein the first and the second side brush deflectors are arranged to form a debris chute configured to deflect debris propelled by the at least one side brush towards the vacuum inlet.

11. The robot cleaner of claim 10, wherein the debris chute tapers in a direction moving from the front of the robot cleaner towards the vacuum inlet.

12. The robot cleaner of claim 8, wherein the at least one side brush deflector is disposed at least partially between the driven wheel and the vacuum inlet.

13. A robot cleaner comprising:

a body including a front, a rear, and a vacuum inlet disposed therebetween;

at least one driven wheel;

at least one side brush comprising a hub configured to rotate about a pivot axis and a plurality of side brush bristles extending from the hub beyond a periphery of the body, the pivot axis being disposed in front of the vacuum inlet;

and at least one side brush deflector at least partially disposed between the vacuum inlet and the pivot axis of the at least one side brush, the at least one side brush deflector comprising at least one of a strip of flexible material or a plurality of deflector bristles extending downwardly from a floor facing surface of the robot cleaner and configured to contact a floor such that the at least one side brush deflector is configured to deflect debris propelled by the at least one side brush towards the vacuum inlet and at least some of the plurality of side brush bristles pass through or underneath at least a portion of the at least one side brush deflector.

14. The robot cleaner of claim 13, wherein the at least one side brush deflector includes a first and a second side brush deflector extending along a first and a second longitudinal axis and downwardly from the floor facing surface of the robot cleaner generally towards the floor, wherein the first and second longitudinal axes tapered towards the vacuum inlet.

15. The robot cleaner of claim 14, wherein the debris chute tapers in a direction moving from the front of the robot cleaner towards the vacuum inlet.

16. The robot cleaner of claim 13, wherein the at least one side brush deflector is disposed at least partially between the driven wheel and the vacuum inlet.

17. The robot cleaner of claim 13, wherein the at least one side brush deflector comprises at least one strip of flexible material extending downwardly from the floor facing surface of the robot cleaner generally towards the floor.

18. The robot cleaner of claim 13, wherein the at least one side brush deflector comprises a plurality of deflector bristles extending downwardly from the floor facing surface of the robot cleaner generally towards the floor.

* * * * *